US006039431A

United States Patent [19]

Yui et al.

[11] Patent Number: 6,039,431

[45] Date of Patent: Mar. 21, 2000

[54] PRINTER HEAD CLEANING DEVICE FOR INK JET PRINTER

[75] Inventors: Yasuji Yui, Kanagawa; Toshiki Kagami, Tokyo, both of Japan

[73] Assignee: Sony Corporation, Japan

[21] Appl. No.: 08/945,542

[22] PCT Filed: Feb. 27, 1997

[86] PCT No.: PCT/JP97/00590

§ 371 Date: Oct. 29, 1997

§ 102(e) Date: Oct. 29, 1997

[87] PCT Pub. No.: WO97/31780

PCT Pub. Date: Sep. 4, 1997

[30] Foreign Application Priority Data

Feb. 29, 1996 [JP] Japan ..... P8-043557

[51] Int. Cl.[7] ..... B41J 2/165

[52] U.S. Cl. ..... 347/30; 347/31

[58] Field of Search ..... 347/30, 108, 29, 347/31, 22–24, 36, 85

[56] References Cited

U.S. PATENT DOCUMENTS 5,373,936 12/1994 Kawai et al. ..... 347/30

FOREIGN PATENT DOCUMENTS

| | | |
|---|---|---|
| 60-71259 | 4/1985 | Japan . |
| 3-205154 | 9/1991 | Japan . |
| 6-305160 | 1/1994 | Japan . |
| 6-286157 | 11/1994 | Japan . |
| 7-89096 | 4/1995 | Japan . |

*Primary Examiner*—N. Le
*Assistant Examiner*—Judy Nguyen
*Attorney, Agent, or Firm*—Rader, Fishman & Grauer; Ronald P. Kananen

[57] ABSTRACT

A printer head cleaning device for ink jet printers, having a case body with a receiving portion for receiving a printer head, and a sucking portion for carrying out suction of ink from the printer head. The receiving portion comprises a contact portion in contact with the injection or jet nozzle of the printer head. The sucking portion comprises a supply portion for applying negative pressure to the contact portion. When negative pressure is applied to the receiving portion, suction of ink existing within the injection or jet nozzle is carried out. Because a water-holding member is provided, drying of the injection or jet nozzle is prevented. The cleaning device also can select suction operation and can control the continuous suction operation and strength of the suction force, thereby making it possible to carry out cleaning of the printer head.

6 Claims, 4 Drawing Sheets

PRINTER HEAD CLEANING DEVICE FOR INK JET PRINTER

DESCRIPTION

1. Technical Field

This invention relates to a cleaning device for cleaning the printer head of the ink jet printer, and more particularly to a device for cleaning the injection or jet nozzle of the printer head.

2. Background Art

Hitherto, there have been used ink jet printers of the on demand system adapted for injecting ink for printing from the injection or jet nozzle of the printer head to record, as visible information, recording information onto a recording medium such as paper or film, etc. The ink jet printer of the on demand system is adapted to print recording information sent from the computer in accordance with a request from the computer.

Meanwhile, at office, etc., preparation of documents using computer called desk top publishing is carried out. In this preparation of documents, it is required to print not only characters or graphics, but also color natural pictures (picture images) such as photograph, etc. along with characters or graphics.

In this case, in order to print the natural picture (picture image) at high grade, it is necessary to faithfully reproduce intermediate color in accordance with recording information.

The ink jet printer is adapted to apply pressure onto ink, e.g., by deformation of piezo element to inject the ink as ink droplet from the injection or jet nozzle of the printer head. Quality of picture (picture image) printed by this printer depends upon the number of dots per unit area formed by ink droplet injected or blown out from the injection or jet nozzle. In order to obtain high quality picture, it is necessary to thin the diameter of the injecting holes of the injection nozzle down to the size of several 10 $\mu$m. When the injecting holes are caused to be small, ink clogging is caused to easily take place at the injection nozzle.

In order to eliminate such ink clogging in the injection nozzle, it is necessary at the ink jet printer of this kind to regularly carry out cleaning to conduct elimination of ink clogged within the injection or jet nozzle. In addition, it is necessary to regularly fill ink necessary for print.

In view of the above, in the ink jet printer of this kind, there is provided a mechanism for carrying out cleaning of the injection nozzle and for carrying out filling of ink.

In the conventional ink jet printer, since the space that the mechanism for carrying out cleaning of the injection or jet nozzle or filling of ink occupies is large, the printer itself is caused to be large. Moreover, since there is such a necessity to carry out regular cleaning of the injection nozzle and/or control of filling of ink, the operation in printing recording information sent from the computer becomes complicated.

Further, since ink used in the ink jet printer is in liquid state, it is necessary for maintaining ink in the liquid state at all times without solidifying ink to allow the injection nozzle of the printer head to be in wet state at all times. In order to allow the injection nozzle to be in wet state as stated above, it is necessary to detach the printer head from the printer when the printer is not used to store it within a storage vessel adapted so that drying is prevented.

DISCLOSURE OF THE INVENTION

An object of this invention is to provide a printer head cleaning device capable of eliminating the problems that the conventional ink jet printer has.

Another object of this invention is to provide a printer head cleaning device capable of easily cleaning the injection or jet nozzle of the printer head.

A further object of this invention is to provide a printer head cleaning device capable of preventing drying of the injection or jet nozzle of the printer head without allowing the printer itself to be large.

A still further object of this invention is to provide a printer head cleaning device which can be used as a vessel for storage of the printer head independent of the printer.

A printer head cleaning device for an ink jet printer according to this invention proposed in order to attain objects as described above comprises, at a case body, a receiving portion for receiving a printer head, and a sucking portion for carrying out suction of ink from the printer head received at the receiving portion.

In this case, the receiving portion comprises a contact portion in contact with the injection or jet nozzle of the printer head. The sucking portion comprises a supply portion for applying negative pressure to the contact portion. Negative pressure is applied to the receiving portion, whereby suction of ink existing within the injection or jet nozzle caused to be in contact with the contact portion is carried out.

Water-holding member is provided at the contact portion, whereby drying of the injection or jet nozzle of the printer head received at the receiving portion is prevented.

The printer head cleaning device for ink jet printer further comprises an input section for selecting sucking operation of the sucking portion and a control section for controlling the operation of the sucking portion on the basis of input from the input section. This control section controls at least continuous sucking operation and strength of suction force of the sucking portion on the basis of input from the input section.

The printer head cleaning device for ink jet printer further comprises a cover body rotatably provided at the case body, and an insertion portion provided at the cover body and adapted to be inserted into the supply hole of the printer head. This device further comprises a detecting section for detecting opening/closing operation of the cover body, and a control section for controlling the operation of the sucking portion on the basis of input from the detecting section.

BEST MODE FOR CARRYING OUT THE INVENTION

An embodiment of a printer head cleaning device for ink jet printer according to this invention will now be described with reference to the attached drawings.

Figure 1:
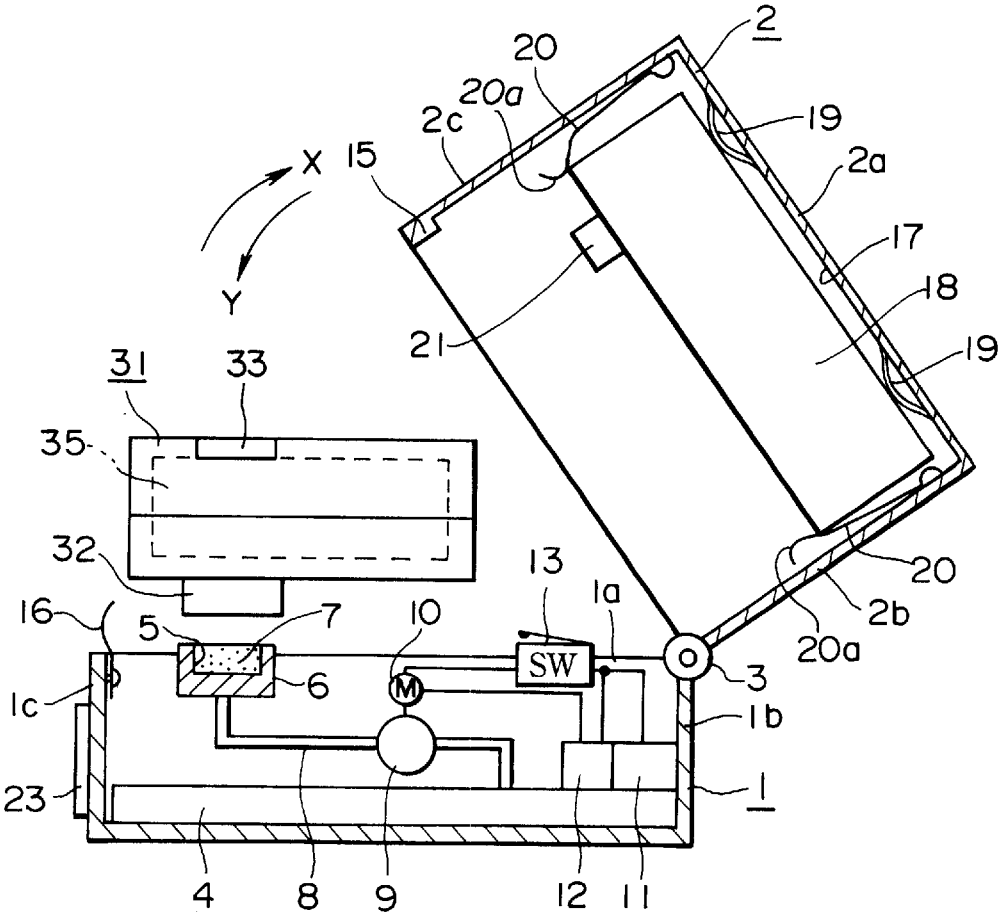
FIG. 1 is a side cross sectional view showing a printer head cleaning device for ink jet printer according to this invention, wherein the state where the cover body is opened is shown.
Figure 2:
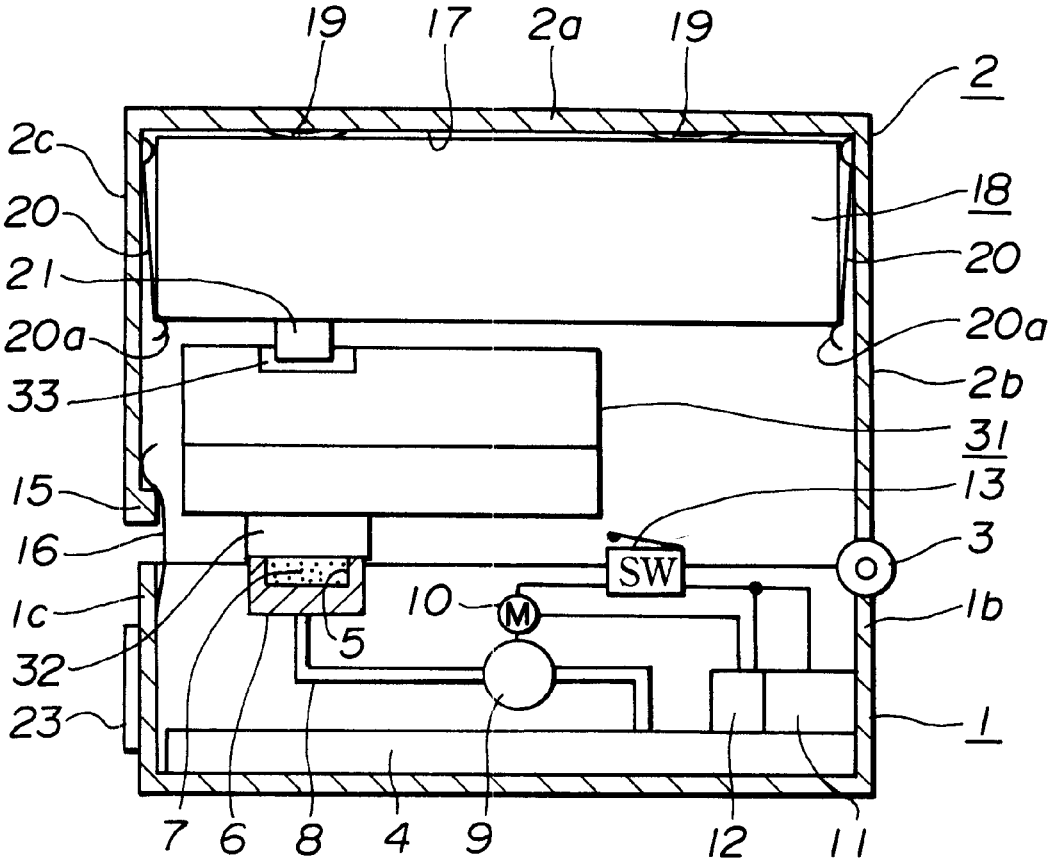
FIG. 2 is a side cross sectional view of the state where the cover body is closed of the device.

The printer head cleaning device for ink jet printer according to this invention comprises a case body 1 formed by using synthetic resin material as shown in FIGS. 1 and 2. At this case body 1, there is provided a cover body 2 formed so as to take a form of parallelepiped and for opening or closing an opening portion 1*a* constituted at the upper surface side. This cover body 2 is adapted so that one side of the base end portion side thereof is rotatably attached at one side of the case body 1 upper end side through a hinge portion 3. As this cover body 2, it is sufficient to employ a cover body which can be rotatably supported with respect to the case body 1. Various rotational supporting mechanisms may be used.

Within the case body 1, a waste liquid chamber 4 is provided at the bottom portion side thereof. Ink sucked from the printer head is stored within this waste liquid chamber 4. At the opening portion 1*a* side which is the upper surface side within the case body 1, an ink sucking portion 6 having an ink sucking hole 5 is provided. Within the ink sucking hole 5, a water-holding member 7 formed by material having water-holding property such as polyurethane foam or felt, etc. is disposed in such a manner that it is filled. In this case, as described later, the ink sucking hole 5 constitutes a receiving portion by which the printer head of the ink jet printer can be received, and the upper surface side of the water-holding member 7 functions as a contact portion of the printer head. At this time, the water-holding member 7 is disposed in the state positioned within the ink sucking hole 5 in a manner substantially flush with the upper end side of the ink sucking hole 5 or surrounded by the peripheral wall of the ink sucking hole 5. Namely, there is employed such a configuration for the purpose of allowing ink sucked from the printer head to be securely sucked into the ink sucking hole 5 without being scattered toward the outside of the ink sucking hole 5.

Between the ink sucking portion 6 and the waste liquid chamber 4, a hollow tubular connecting tube is connected. This connecting tube constitutes a suction passage 8 of ink sucked by the ink sucking portion 6. In the middle of the suction passage 8, a suction pump 9 is provided. The suction pump 9 is driven by a motor 10. This motor 10 is caused to undergo drive control by a motor drive control circuit section 12 controlled by a control circuit section 11 to drive the suction pump 9. A contact type detecting switch 13 for detecting opening/closing state of the cover body 2 is connected to the motor drive control circuit section 12.

At the upper end side of a front wall 1*c* opposite to a back face wall 1*b* for rotatably supporting the cover body 2 of the case body 1, there is attached a holding spring 16 constituting the lock mechanism which is relatively engaged with an engagement portion 15 provided at the cover body 2 rotated at the position where it closes the opening portion 1*a* of the case body 1 to thereby lock the cover body 2 at a closing position.

On the other hand, at the internal side of the cover body 2 and at the upper side of the top plate 2*a* side, as shown in FIGS. 1 and 2, a cartridge accommodating portion 17 is provided. An ink cartridge 18 within which various color inks such as yellow, magenta, green or black, etc. are filled is detachably fitted in order to permit color printing with respect to the cartridge accommodating portion 17. At the lower surface side of the ink cartridge 18, there is provided an ink supply hole 21 for supplying ink filled within the ink cartridge 18 to the printer head as described later.

Further, at the cartridge accommodating portion 17, there are provided plural pressing springs 19 for pressing and supporting the upper surface side of the ink cartridge 18, and a pair of supporting springs 20 abated to be held with respect to the corner portions of the lower end side opposite to each other of the ink cartridge 18 to carry out supporting of the ink cartridge 18. The pressing springs 19 are attached along the inner surface of a top plate 2*a* of the cover body 2, and the supporting springs 20 are attached along the inside surfaces of a back face wall 2*b* and a front face wall 2*c* opposite to each other of the cover body 2. At the supporting springs 20, holding portions 20*a* formed in a curved manner so that they can be held at the corner portions of the lower end side of the ink cartridge 18 are formed at the front end side thereof.

The engagement portion 15 engaged with the holding spring 16 provided at the case body 1 side is formed in a manner positioned in the vicinity of the opening end of the other side wall 2*c* of the cover body 2.

Figure 3:
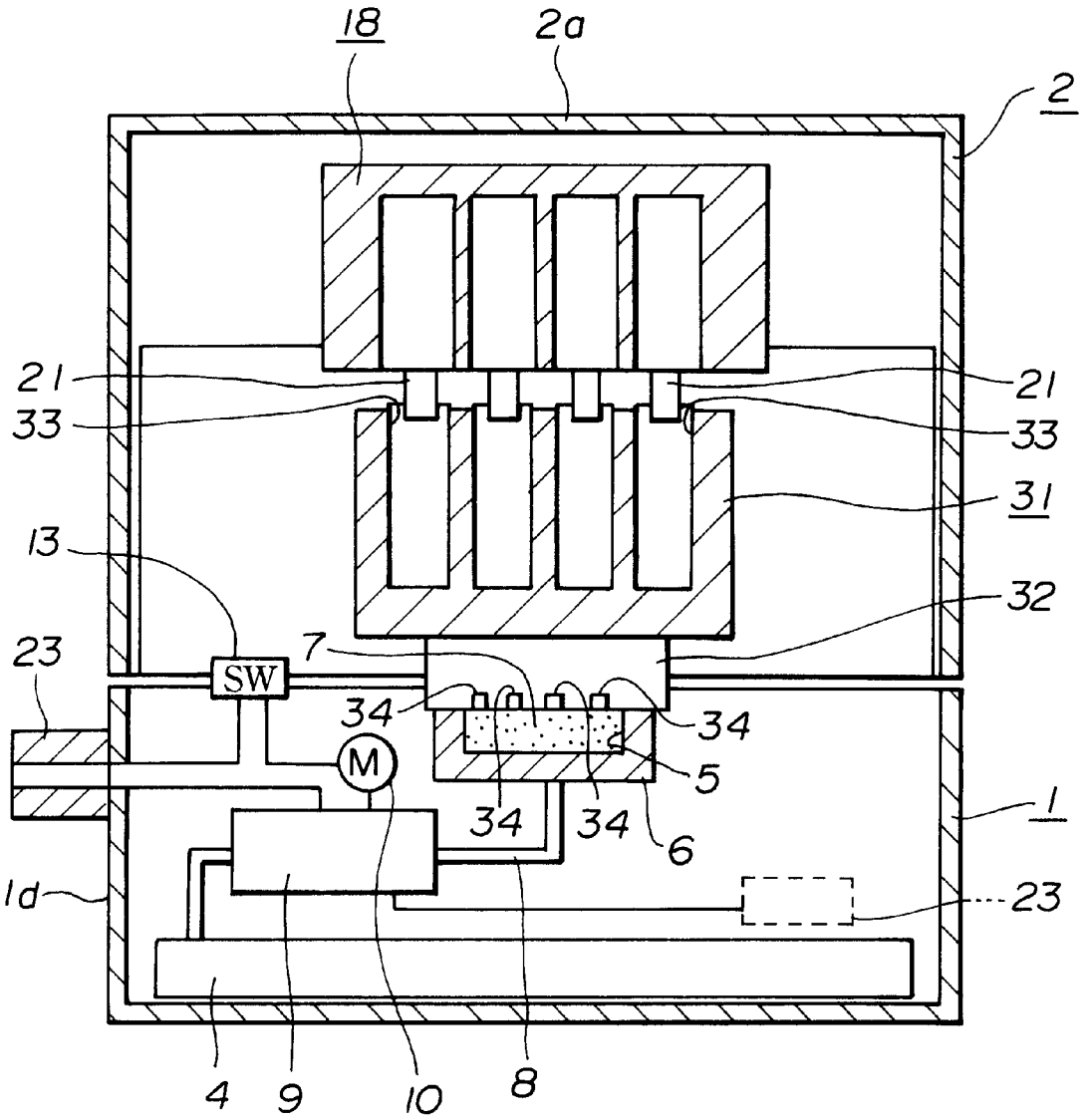
FIG. 3 is a front cross sectional view of the state where the cover body is closed of the device.
Figure 4:
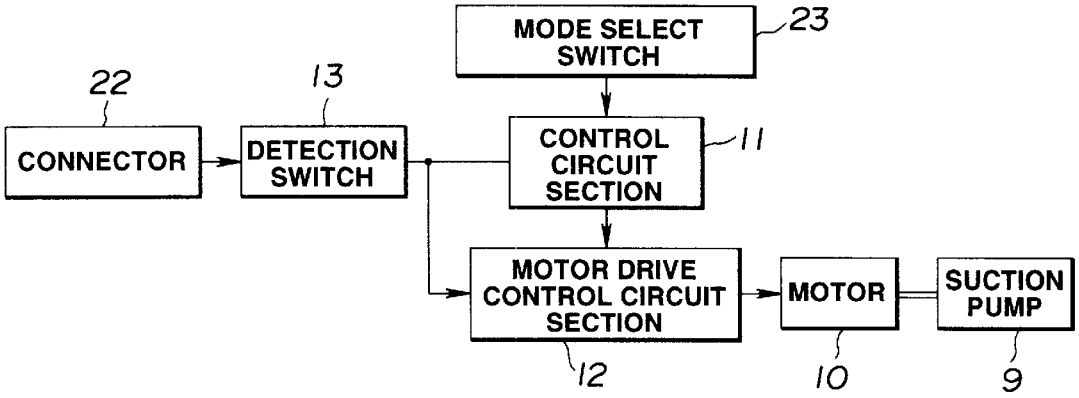
FIG. 4 is a block circuit diagram showing the control system of the printer head cleaning device for ink jet printer according to this invention.

At the outside surface side of one side wall 1*d* of the case body 1, as shown in FIG. 3, there is provided a connector 22 supplied with external power for driving this printer cleaning device. As shown in FIG. 4, this connector 22 is electrically connected to the detection switch 13, the motor drive control circuit section 12, and the control circuit section 11 within the case body 1.

Further, memory is provided in the control circuit section 11, and various operation modes of this printer head cleaning device are stored therein. As the operation mode, there are intermittent suction mode for intermittently driving the motor 10 to allow the suction pump 9 to be intermittently operative to carry out the intermittent suction, continuous suction mode for continuously driving the motor 10 to continuously carry out sucking operation by the suction pump 9, and adjustable suction mode for driving the motor 10 while allowing the rotational speed thereof to be adjusted at a fixed period to strengthen or weaken (adjust) the suction force of the suction pump 9 to carry out suction. In this case, with respect to the operation mode, by setting the drive state of the motor 10 in various manners, sucking states of the suction pump 9 are diversely set. Thus, various suction modes can be set.

At the outside surface side of the front wall 1*c* of the case body 1, as shown in FIGS. 1 and 2, there is provided a mode select switch 23 for selecting any one of various suction modes stored in the control circuit section 11. This mode select switch 23 is connected to the control circuit section 11 within the case body 11 as shown in FIG. 4.

The operation for cleaning the printer head of the ink jet printer by using the printer head cleaning device constituted as described above will now be described.

Initially, the printer head designated at 31 which is caused to undergo cleaning will be explained. At the printer head 31, as shown in FIGS. 1 and 3, an injection or jet nozzle 32 for injecting ink is provided at the lower surface side thereof, and an ink receiving hole 33 for receiving ink delivered from the ink cartridge 18 is provided at the upper surface side opposite to the surface where the injection nozzle 32 is provided. At the injection nozzle 32, as shown in FIG. 3, there are provided a large number of ink injecting holes 34 having the inside diameter of about 10 $\mu$m. Further, within the printer head 31, there is provided an ink reservoir 35 for storing ink delivered from the ink cartridge 18.

In order to carry out cleaning of the printer head 31, the cover body 2 is rotationally operated in the direction indicated by arrow X in FIG. 1 with the hinge portion 3 being as the center to open the opening portion 1*a* of the case body 1. Then, the ink cartridge 18 is fitted into the cartridge accommodating portion 17 constituted within the opened cover body 2. At this time, the ink cartridge 18 is inserted into the portion between a pair of supporting springs 20, 20 in the state where the ink supply hole 21 is directed toward the case body 1 side. When the upper surface side opposite to the side where the ink supply hole 21 is provided of the ink cartridge 18 is thrust (or forced into the cartridge accommodating portion 17) until it comes into contact with the pressing springs 19, the ink cartridge 18 is fitted into the cartridge accommodating portion 17 as the result of the fact that holding portions 20*a* of the pair of supporting springs 20, 20 are held by the corner portions of the lower end side. The ink cartridge 18 fitted within the cartridge accommodating portion 17 is elastically supported as the result of the fact that the upper surface side is pressed by the pressing springs 19 and the corner portions of the lower end side are supported by the supporting springs 20. Namely, the ink cartridge 18 is supported within the cartridge accommodating portion 17 in the stable state where shaking is prevented.

After the ink cartridge 18 is accommodated within the cartridge accommodating portion 17, the printer head 31 is disposed within the case body 1 as shown in FIG. 1. At this time, as shown in FIG. 3, the printer head 31 is disposed within the case body 1 in such a manner that the injection nozzle 32 is directed toward the lower direction and the ink injecting holes 34 of the injection nozzle 32 are received into the ink sucking hole 5 of the ink sucking portion 6. At this time, the front end of the injection nozzle 32, i.e., the opening ends of the ink injecting holes 34 are caused to be in contact with the water-holding member 7 filled within the ink sucking hole 5. As the result of the fact that the ink injecting holes 34 are caused to be in contact with the water-holding member 7 as stated above, drying of the injection nozzle 32 is prevented. Thus, drying of ink existing within the injection nozzle 32 is prevented.

When the printer head 31 is disposed at the case body 1 thereafter to rotate the cover body 2 in the direction indicated by arrow Y in FIG. 1 with the hinge portion 3 being as the center so that it is located at the position where the opening portion 1*a* of the case body 1 is closed, the engagement portion 15 is engaged with the holding spring 16. Thus, as shown in FIG. 2, the cover body 2 is locked with respect to the case body 1 in the state where the case body 1 is closed.

At this time, as shown in FIG. 2, the ink supply hole 21 of the ink cartridge 18 is fitted into the ink receiving hole 33 of the printer head 31. When the cover body 2 is rotated until it is located at the position where it is locked by the case body 1, the detection switch 13 is caused to undergo pressing operation by the cover body 2 so that it is in ON state. As a result, power is delivered to the motor drive control circuit section 12 and the control circuit section 11 through the connector 22. Then, the mode select switch 23 is operated to select suction mode corresponding to the state of the printer head 31 caused to undergo cleaning. When this suction mode is selected, the control circuit section 11 delivers a control signal corresponding to the selected suction mode to the motor drive control circuit section 12 as indicated by the circuit diagram of FIG. 4. As a result, the motor 10 starts drive operation in the state where its rotation is controlled by this motor drive control circuit section 12 to operate the suction pump 9. When the suction pump 9 is operated, air of the ink sucking portion 6 is sucked through the ink suction passage 8. As a result, the ink sucking portion 6 is placed in negative pressure state. Thus, the injection nozzle 32 of the printer head 31 received with respect to the ink sucking portion 6 is sucked. As the result of the fact that the injection nozzle 32 is sucked, ink or dust, etc. existing within the injection nozzle 32 is sucked. Thus, cleaning of the injection nozzle 32 is carried out.

At this time, the suction pump 9 is driven in the intermittent suction mode for carrying out intermittent suction, the continuous suction mode for continuously carrying out the suction operation, or the adjustable suction mode for adjusting strength of the suction force, which corresponds to the suction mode selected by the mode select switch 23.

Assuming now that the intermittent suction mode for carrying out intermittent suction is selected, the injection nozzle 32 is intermittently sucked. Even in the case where, e.g., solidified ink or dust, etc. exists within the injection nozzle 32, the injection nozzle 32 can be securely sucked by adjustment of the suction force. Thus, cleaning of the injection nozzle 32 is carried out.

When the suction pump 9 starts its operation so that the interior of the printer head 31 is sucked, ink within the ink cartridge 18 is filled within the ink reservoir 35 of the printer head 31 through the ink supply hole 21 fitted in the ink receiving hole 33. At this time, old ink existing within the injection nozzle 32 is sucked. As a result, this old ink is replaced by new ink delivered from the ink cartridge 18. Thus, cleaning of the injection nozzle 32 is carried out.

Namely, every time supply of ink into the printer head 31 is carried out, cleaning of the printer head 31 is conducted.

In this example, ink sucked by the suction pump 9 is sent (delivered) to the waste liquid chamber 4 through the ink suction passage 8.

Since this printer head cleaning device can accommodate the printer head 31 in the state where the ink injecting holes 34 are caused to be in contact with the water-holding member 7 even in the state where no power is supplied through the connector 22, i.e., the cleaning operation or the filling operation of ink is not carried out, the injection nozzle 32 can be kept in moderate wet state. Accordingly, hardening of ink existing within the injection nozzle 32 can be prevented. Thus, this printer head cleaning device can be used as a storage box for storing the printer head 31 in the usable state at all times.

INDUSTRIAL APPLICABILITY

Since the printer head cleaning device according to this invention is of the structure independent of the ink jet printer, there is no possibility that the printer itself is caused to be large.

Further, since the operation mode of cleaning can be suitably selected in dependency upon the state of the printer head caused to undergo cleaning, it is possible to securely carry out cleaning of the printer head.

In addition, even in the state where no cleaning operation is carried out, the printer head cleaning device can be utilized as a storage box for the printer head.

We claim:

1. A printer head cleaning device for an ink jet printer comprising:

a case body;

a receiving portion provided at the case body and adapted for receiving a printer head; and a sucking portion, also provided at said case body and attached to said receiving portion, adapted for carrying out suction of ink from the printer head received at the receiving portion;

wherein the device further comprises a cover body rotatably provided at the case body, and an insertion portion also provided at the cover body and inserted into a receiving hole of the printer head.

2. A printer head cleaning device for an ink jet printer as set forth in claim 1, wherein the receiving portion comprises a contact portion in contact with an injection or jet nozzle of the printer head received at the receiving portion, and the sucking portion comprises a supply portion for applying negative pressure to the contact portion.

3. A printer head cleaning device for an ink jet printer as set forth in claim 2, wherein the contact portion is comprised of a water-holding member in contact with the injection or jet nozzle of the printer head received at the receiving portion.

4. A printer head cleaning device for an ink jet printer as set forth in claim 2, wherein the device further comprises an input section for selecting suction operation of the sucking portion and a control section for controlling the operation of the sucking portion on the basis of input from the input section.

5. A printer head cleaning device for an ink jet printer as set forth in claim 4, wherein the control section controls at least continuous suction operation and strength of suction force of the sucking portion on the basis of input from the input section.

6. A printer head cleaning device for an ink jet printer as set forth in claim 1, wherein the device further comprises a detecting section attached to said case body, for detecting opening/closing operations of the cover body, and a control section, attached to said case body and electrically connected to said detecting section, for controlling the operation of the sucking portion on the basis of input from the detecting section.

* * * * *